US005086579A

United States Patent [19]

Flatley et al.

[11] Patent Number: 5,086,579

[45] Date of Patent: Feb. 11, 1992

[54] DECOCKING MECHANISM FOR A SEMI-AUTOMATIC FIREARM

[75] Inventors: Stephen L. Flatley, West Springfield, Mass.; Donald B. Mears, Jr., Enfield, Conn.

[73] Assignee: Smith & Wesson Corp., Springfield, Mass.

[21] Appl. No.: 628,444

[22] Filed: Dec. 17, 1990

[51] Int. Cl.[5] ..... F41A 17/74

[52] U.S. Cl. ..... 42/70.08; 42/69.03

[58] Field of Search ..... 89/132; 42/69.03, 70.08

[56] References Cited

U.S. PATENT DOCUMENTS

| | | | |
|---|---|---|---|
| 4,481,863 | 11/1984 | Zanner et al. | 42/69.03 |
| 4,768,302 | 9/1988 | Beretta | 42/70.08 |
| 5,000,075 | 3/1991 | Tuma | 89/147 |

OTHER PUBLICATIONS

*American Rifleman*, "Astro A-80 Pistol", Sep. 1981, pp. 60-62.

*Primary Examiner*—Michael J. Carone

*Attorney, Agent, or Firm*—Chapin, Neal & Dempsey

[57] ABSTRACT

Improved decocking mechanism for a semi-automatic firearm has a lever pivotable on one side of the frame of the gun. One end of the lever includes an actuator and the opposite end, has a sector gear meshed with the toothed surface of a pawl rotatable on the hammer pin between a first position and a second position. The pawl is disposed adjacent the hammer and includes a first leg engageable with the sear to pivot the same against sear spring pressure out of engagement with a first notch adapted for holding the hammer in its fully cocked position. The pawl includes a second leg engageable with the drawbar to pivot the same downwardly to prevent its engagement with the sear in response to the trigger pull. The hammer includes a second notch engageable with the sear to hold the hammer in a half-cocked position and a reset pin disposed to engage the first leg and to return the pawl and the decocking lever to their at-rest positions upon forward rotation of the hammer. A decocking lever spring serves to urge the decocking lever to its initial position.

4 Claims, 2 Drawing Sheets

DECOCKING MECHANISM FOR A SEMI-AUTOMATIC FIREARM

BACKGROUND OF THE INVENTION

This invention relates to a decocking mechanism for semi-automatic handguns, or pistols, in which operation of the mechanism will cause the sear to release the hammer from its fully cocked position to a half-cocked position. More particularly, this invention relates to an effective and reliable decocking mechanism which includes means rotatable to pivot the sear to release the hammer for movement to the half-cocked notch of the hammer and to pivot the drawbar to clear the sear so that the trigger cannot fire the gun when it is being decocked.

Semi-automatic firearms have, for a number of years, been provided with decocking levers which have gained acceptance among handgun users. One such decocking lever is disclosed in U.S. Pat. No. 4,481,863, dated Nov. 13, 1984.

While, in particular pistol models, decocking levers of this and other similar types have proven to be suitable for their intended purposes of decocking the hammer, these mechanisms have not found wide acceptance because, as constructed, they are not adaptable to various models. In this connection, a Sig Sauer handgun is presently available with a decocking lever that serves to release the sear and also to control the movement of the hammer from its fully cocked to its half-cocked position. In this model, the decocking lever, hammer and sear are all generally disposed in the same vertical plane as the firing mechanism. While this planar relationship of the decocking lever and the hammer is suitable for Sig Sauer's firing mechanisms, it is not adaptable to many other types of handguns, commercially available, including those manufactured by Smith & Wesson. Those models include a bifurcated drawbar with portions that extend from the trigger on opposite sides of the magazine and a cross-bar portion which engages the rear of the sear to pull it forward to release the hammer.

The principal object of this invention is to provide an improved decocking mechanism for semi-automatic firearms in which the movement of the sear to release the hammer from its cocked position, movement of the hammer to its half-cocked position and movement of the drawbar to clear the sear are controlled by a downwardly, pivotable decocking lever disposed adjacent to one side of the plane of movement of the hammer.

Another object of this invention is to provide a simple and reliable decocking mechanism which is adapted for installation on existing models of handguns without the necessity of modifying the guns' firing mechanism.

The above and other objects and advantages of this invention will be more readily apparent from the following description read in conjunction with the accompanying drawings in which.

Figure 1:
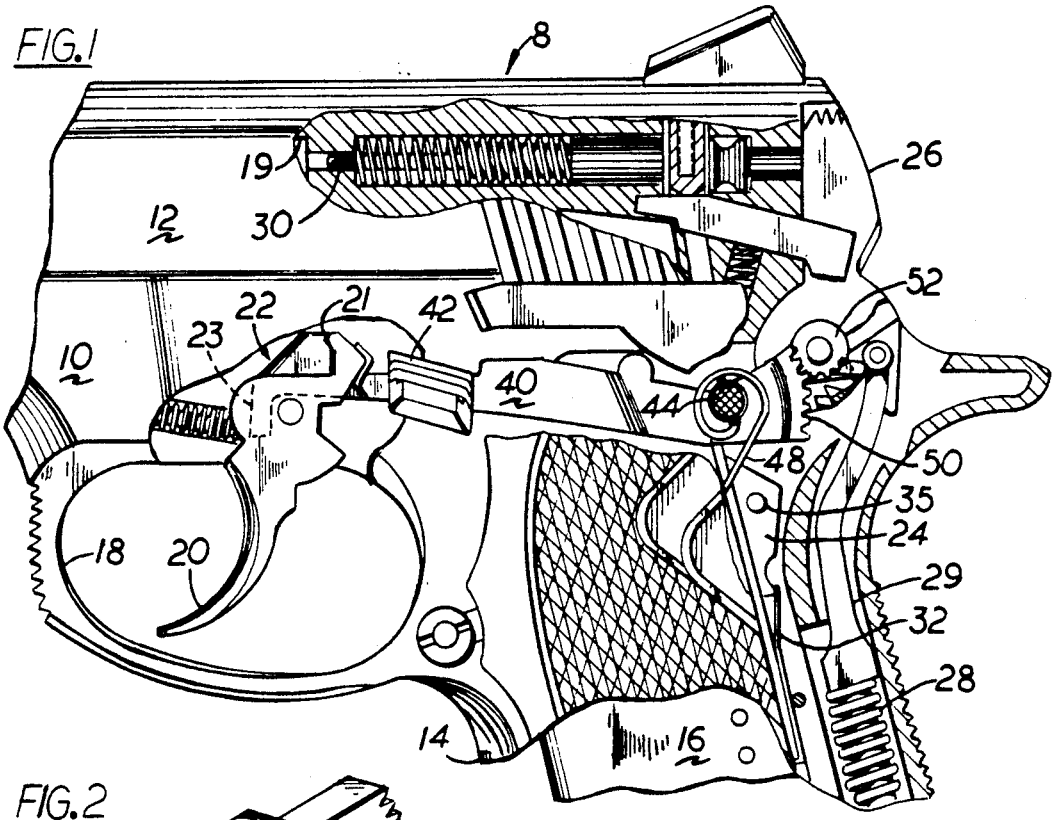
FIG. 1 is a partial side elevational view, partly in section, of a pistol provided with a decocking mechanism of the type embodying this invention.

Referring in detail to the drawings, in FIG. 1 is shown a semi-automatic pistol 8 which comprises a frame 10 and a reciprocably movable slide 12. The frame includes the handle 14 into which a cartridge magazine 16 is removably fitted and a trigger guard 18 is disposed about trigger 20. The trigger, as is conventional, actuates the operation of the firing mechanism of the pistol.

Figure 3:
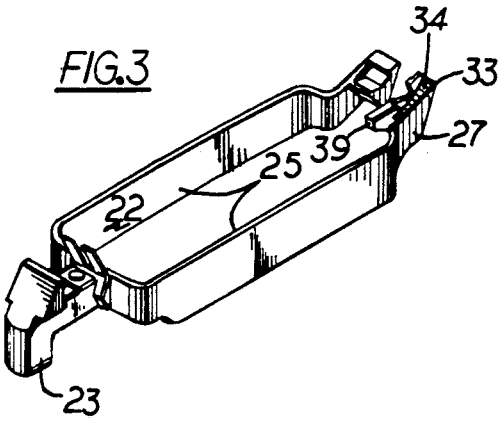
FIG. 3 is a perspective view of the drawbar used in the pistol of FIG. 1.
Figure 5:
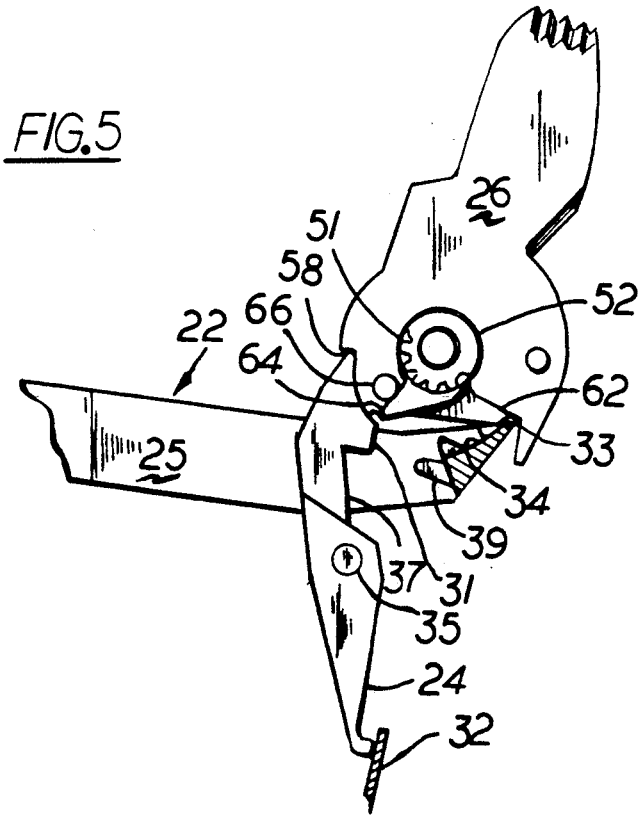

The firing mechanism comprises a trigger bar, or drawbar 22, sear 24, hammer 26, main spring 28 and firing pin 30. The drawbar (FIGS. 1 and 3) includes a toe portion 23 engaged with trigger points 21 at its forward end, a pair of laterally spaced vertically oriented, parallel bars, or rails 25 which extend on opposite sides of the magazine, a cross-bar 27 adapted to pivot the sear forwardly and a tongue 39 adapted to fit into slot 41 of the sear and to operate the disconnector (not shown). When, in firing the gun, the trigger is moved rearwardly, the cross-bar 27 of the drawbar 22 will engage lobe 31 (FIG. 5) of the sear 24 above undercut recess 37 and pivot the sear forwardly about sear pin 35. The sear will move against the tension of sear spring 32 to release the hammer from its fully cocked position. Upon the release of the hammer, energy of spring 28, transferred to the hammer by stirrup 29, will forcefully rotate the hammer 26 forwardly until it impacts against the firing pin 30 and thereby cause a round of ammunition disposed in the chamber 19 to be fired. During this sequence, the drawbar 22 holds the sear clear of the hammer until it rotates sufficiently so that the half-cocked notch 58 has passed the upper tip of the sear. When the round is fired, the slide 12 will be moved rearwardly by gas blow-back to eject the spent cartridge case and as it moves forwardly, the slide will pick up another round from the magazine 16. Hammer 26 will also have been fully cocked by the rearward movement of the slide 12. A round will now be in the chamber 19 and the hammer will be fully cocked. Should the shooter decide, at this time, not to fire the chambered round, he may decock the firing mechanism and, in accordance with this invention, can readily do so in a safe and simple manner by operating the decocking lever 40 using the thumb of the shooter's right hand.

Figure 2:
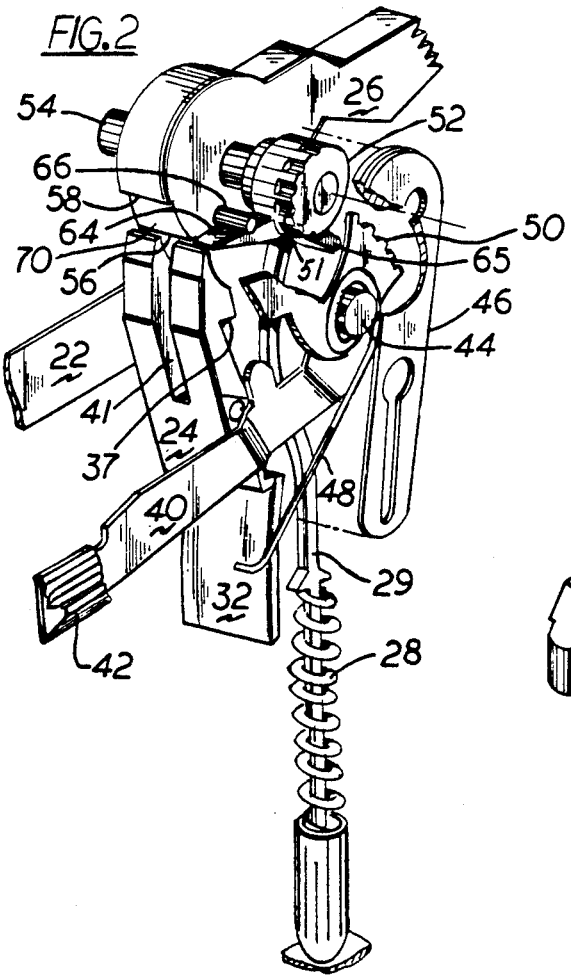
FIG. 2 is a partial exploded perspective view of the decocking mechanism of the type embodying this invention.

As best illustrated in FIGS. 1 and 2, the decocking mechanism embodying this invention, comprises the lever 40 disposed on the left side of the frame in a convenient position to be actuated by the thumb of the shooter's right hand. A stepped actuator pad 42 is disposed on the forward edge of the lever for convenient operation by the thumb of the shooter's right hand. A pivot pin 44 extends laterally from the surface of the lever 40 through a hole in a side plate 46 mounted in fixed relation on the frame 10. A spring 48 has one end captured in a hole disposed transversely of the pin 44 and its other end is captured by a portion of frame 10. The spring 48 urges the forward end of the decocking lever upwardly, or clockwise. The opposite end of the lever 40 is provided with a sector gear 50 with the teeth thereof arranged in arcuate configuration in order to mesh with the toothed portion 51 of pawl 52. The pawl 52 is disposed adjacent the hammer 26 and is mounted on the hammer pin 54 and is rotatable thereon independently of the hammer. Hammer 26 is urged forwardly by main spring 28 which is compressed when the hammer is in its fully cocked position, as depicted in FIG. 2.

In that position, the upper edge of the sear 24 engages a notch 56 formed in the peripheral edge of the hammer 26 to hold the hammer in its fully cocked position. A second notch 58 is also provided on the hammer for engagement with the upper edge of the sear 24 when the hammer 26 is in its half-cocked position, accomplished by moving the decocking lever 40 downwardly.

Figure 4:
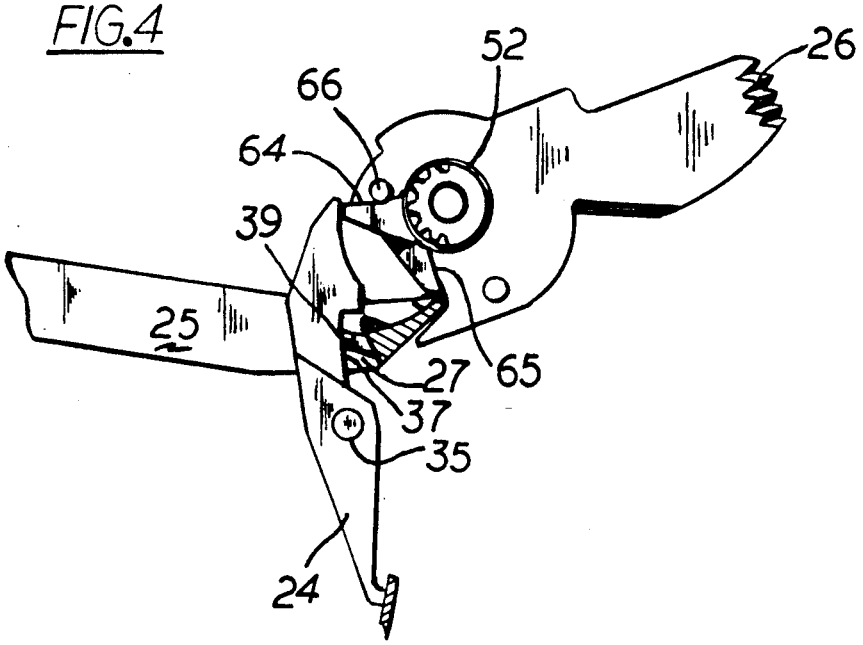
FIGS. 4 and 5 are side elevational views, partly in section, which show portions of the decocking mechanism in different operative positions.

Pawl 52 comprises a cylindrical gear having a sprocket, or partially toothed, peripheral portion 51 adapted to mesh with the teeth of sector gear 50 on the after-end of the decocking lever 40. A first leg 64 extends radially from the outer peripheral edge of the pawl 52 a sufficient distance to engage an upper side surface portion of the sear 24 to pivot the same counterclockwise (FIGS. 2 and 4). The pawl includes a second leg 65 adapted to engage the top rear edge 33 of the after-end of the drawbar 22 to pivot it downward. Forwardly of edge 33, the drawbar is radiused, as at 34, to provide clearance for the leg 64 when the decocking lever is not being used and the drawbar is being moved forwardly by the trigger. As shown in FIGS. 2 and 4, the sear 24 will be moved counterclockwise to disengage hammer notch 56 when the decocking lever is moved downward and the pawl 52 is rotated clockwise. Simultaneously, the rear end of the drawbar 22 will be moved downwardly by leg 65 so that the drawbar, even if moved forwardly in response to the trigger pull, will not engage the lobe 31 of the sear to release the hammer. As a result of such movement of the sear 24, the hammer 26, energized by expansion of the spring 28, rotates counterclockwise and is controlled in the following manner.

The hammer is provided with a reset pin 66 which extends laterally outward from the hammer and in parallel relation to the hammer pin 54. The pin 66 and is spaced from the pin 54 in a direction generally toward notch 56 so that as the sear 24 is disengaged from the hammer notch 56, the pin 66, carried in a counterclockwise direction, will engage the leg 64 of the pawl 52. As a consequence, a portion of the energy of rotation of the hammer will be transferred to the pawl 52 by the pin 66 engaged with the leg 64 to urge the leg in a counterclockwise direction. This movement serves to reposition the pawl 52 to its original position and to thereby release the sear 24 which is then urged by sear spring 32 into engagement with the hammer 26. The sear will thus be oriented to ensure its engagement with the half-cocked notch 58 of the hammer. At the same time, the counterclockwise rotation of the pawl 52 is transmitted by the sprocket 51 to the sector gear 50 whereby the forward end of the lever 40 will, in combination with spring 48, be moved upwardly toward its starting position. When, however, the thumb of the shooter remains engaged with the actuator pad 42, the pawl 52 will serve to control, or slow the decocking movement of the hammer. In addition, as hammer 26 moves forwardly, the sear spring 32 continually urges the upper end of the sear 24 into engagement with the curved surface 70 of the hammer since the drawbar has been moved downward, thus ensuring that the sear 24 will engage the half-cocked notch 58 of the hammer.

It will be noted that the entire decocking mechanism, including the operating lever, the sector gear, the pawl and the pin 66, are all disposed on the same side of the firing mechanism of the handgun so that changes in the construction, or geometric orientation of the components which constitute the firing mechanism of the gun, are not required. Moreover, despite the fact that the mechanism is located on one side of the firing mechanism, because of the gear train arrangement between the decocking lever and the pawl, there is a direct and positive control of the decocking of the hammer and the sear which ensures effective operation of this mechanism.

Having thus described my invention, what is claimed is:

1. In a semi-automatic handgun having a pivotable hammer urged toward a firing position by a main spring, the hammer including a full-cocked notch and a half-cocked notch, a pivotable sear urged by a sear spring toward a position of selective engagement with the hammer notches, and a trigger actuated drawbar adapted to pivot the sear to release the hammer for firing the handgun, an improved decocking mechanism comprising a pivotable lever disposed on at least one side of the handgun, a pawl disposed adjacent the hammer, said pawl being rotatable in response to pivotable movement of the decocking lever, said pawl including means to disengage the sear from the full-cocked notch of the hammer for decocking the hammer and means to move the drawbar to clear the sear should the trigger actuate the drawbar, said hammer including means for resetting the pawl to enable the sear spring to urge the sear toward engagement with the half-cocked hammer notch.

2. In a semi-automatic handgun, an improved decocking mechanism, as set forth in claim 1, in which said means to disengage the sear from the full-cocked hammer notch comprises a first radial extension of the pawl.

3. In a semi-automatic handgun, an improved decocking mechanism, as set forth in claim 2, in which said means to disengage the drawbar from the sear includes a second radial extension of the pawl adapted to pivot the drawbar to a position in which it will not trip the sear in response to the trigger being operated to fire the gun.

4. In a semi-automatic handgun, an improved decocking mechanism, as set forth in claim 3, in which said means for resetting the pawl comprises a projection extending laterally from the hammer which is disposed to engage the first radial extension of the pawl when the hammer is released by the sear and moves forwardly from the full-cocked notch.

* * * * *